US010532476B1

(12) United States Patent
Skarmoutsou et al.

(10) Patent No.: US 10,532,476 B1
(45) Date of Patent: Jan. 14, 2020

(54) DISPENSER FOR RAZOR CARTRIDGE

(71) Applicant: BIC VIOLEX S.A., Anixi Attikis (GR)

(72) Inventors: Amalia Skarmoutsou, Anixi Attikis (GR); Nikos Chatzigrigoriou, Anixi Attikis (GR); Christos Pandis, Anixi Attikis (GR); Nikos Skounakis, Anixi Attikis (GR); Aliki Douka, Anixi Attikis (GR)

(73) Assignee: BIC VIOLEX S.A., Anixi Attikis (GR)

( * ) Notice: Subject to any disclaimer, the term of this patent is extended or adjusted under 35 U.S.C. 154(b) by 0 days.

(21) Appl. No.: 16/034,895

(22) Filed: Jul. 13, 2018

(51) Int. Cl.
*B26B 21/10* (2006.01)
*B26B 21/44* (2006.01)
*B26B 21/40* (2006.01)

(52) U.S. Cl.
CPC ..... *B26B 21/44* (2013.01); *B26B 21/4018* (2013.01)

(58) Field of Classification Search
CPC ..... B26B 21/44; B26B 21/4018
USPC ..... 30/41, 41.5
See application file for complete search history.

(56) References Cited

U.S. PATENT DOCUMENTS 4,716,652 A * 1/1988 Cataudella ..... B26B 21/446 222/386
4,850,107 A * 7/1989 Valliades ..... B26B 21/44 30/41
5,141,349 A * 8/1992 Maguire, Jr. ..... B26B 21/44 30/41
5,903,979 A * 5/1999 Oldroyd ..... B26B 21/44 30/41
6,298,558 B1 10/2001 Tseng et al.
6,450,719 B1 9/2002 Causton et al.
7,103,977 B2 * 9/2006 Guimont ..... B26B 21/44 30/41
7,111,400 B2 * 9/2006 Guimont ..... B26B 21/4087 30/41
7,743,506 B2 * 6/2010 Szczepanowski .... B26B 21/405 219/385
9,446,573 B2 9/2016 Burgio et al.
9,738,000 B2 8/2017 Ariyanayagam et al.
9,764,487 B2 * 9/2017 Robertson ..... B26B 21/521
10,035,275 B2 * 7/2018 Hawes ..... B26B 19/40
10,105,858 B2 * 10/2018 Robertson ..... B26B 21/521
2009/0211099 A1 * 8/2009 Louis ..... B26B 21/44 30/41

(Continued)

FOREIGN PATENT DOCUMENTS

EP 2490868 A1 8/2012
EP 2490869 A1 8/2012

*Primary Examiner* — Omar Flores Sanchez
(74) *Attorney, Agent, or Firm* — Ohlandt, Greeley, Ruggiero & Perle, L.L.P.

(57) ABSTRACT

A retaining element for a razor cartridge has a top portion that includes an aperture therethrough, a bottom portion, and a side portion connecting the top portion to the bottom portion to define a volume between the top portion and the bottom portion, a container having a top opening, a lubricating composition in the container and a first spherical lid to cap the container. The top opening is sized to hold the first spherical lid so that the first spherical lid freely rotates without translation. The container is positioned in the volume so that the first spherical lid at least partially protrudes from the aperture. The lubricating element emits onto an outer surface of the first spherical lid when the first spherical lid rotates.

20 Claims, 3 Drawing Sheets

(56) References Cited

U.S. PATENT DOCUMENTS

| | | | | |
|---|---|---|---|---|
| 2010/0111590 | A1 | 5/2010 | Pires et al. | |
| 2012/0023750 | A1 | 2/2012 | Blatter et al. | |
| 2013/0097868 | A1 * | 4/2013 | Jessemey | B26B 21/4018 30/32 |

* cited by examiner

DISPENSER FOR RAZOR CARTRIDGE

BACKGROUND

1. Field

The present disclosure relates to retaining elements for a razor cartridge having a shaving aid dispenser. The disclosure further relates to razor cartridges including such retaining elements and to razors or razor assemblies including such cartridges with a shaving aid dispenser.

2. Description of Related Art

Razors generally predate the common era. Safety razors including removable blade razors, cartridge razors, and disposable razors have been generally known since the second half of the 20th Century. Disposable safety razors are similar to cartridge razors but are constructed from materials that are inexpensive and are meant to be disposable when the blades dull commonly after one or more uses. Hence, blade sharpening or replacement is not common practice.

SUMMARY

According to aspects of the present disclosure a retaining element for a razor cartridge is provided. The retaining element has a top portion that includes one or more apertures therethrough, a bottom portion, and a side portion connecting the top portion to the bottom portion to define a volume between the top portion and the bottom portion. The retaining element also has a container or dispenser for holding a lubricating element and a first spherical lid to cap the container. The container has a top opening sized to hold the first spherical lid so that the lid can freely rotate without translation. The container is positioned in the volume of the retaining element so that the first spherical lid at least partially protrudes from the apertures of the retaining element. When the first spherical lid rotates, a layer or at least some of the lubricating element is transferred from the container to an outer surface of the first spherical lid.

In another embodiment, a razor cartridge is provided. The cartridge has one or more blades disposed in a housing and one or more retaining elements configured to maintain the blades in the housing. The retaining element has a top portion that includes one or more apertures therethrough, a bottom portion, and a side portion connecting the top portion to the bottom portion to define a volume between the top portion and the bottom portion. The cartridge has one or more dispensers. Each dispenser has a container for holding a lubricating element, with the container is capped with a spherical lid. The container has a top opening sized to hold the first spherical lid so that the lid can freely rotate without translation. The container is positioned in the volume so that the first spherical lid at least partially protrudes from the apertures of the retaining element. When the first spherical lid rotates, a layer or at least some of the lubricating element is transferred from the container to an outer surface of the first spherical lid.

A razor with the cartridge is also provided. The razor cartridge is connected to a handle.

The above summary is not intended to describe each disclosed implementation. In particular, selected features in this disclosure may be incorporated into additional features as detailed herein below unless clearly stated to the contrary.

BRIEF DESCRIPTION OF THE DRAWINGS

The present disclosure will be more completely understood in consideration of the following detailed description in connection with the accompanying drawings, in which.

Figure 1:
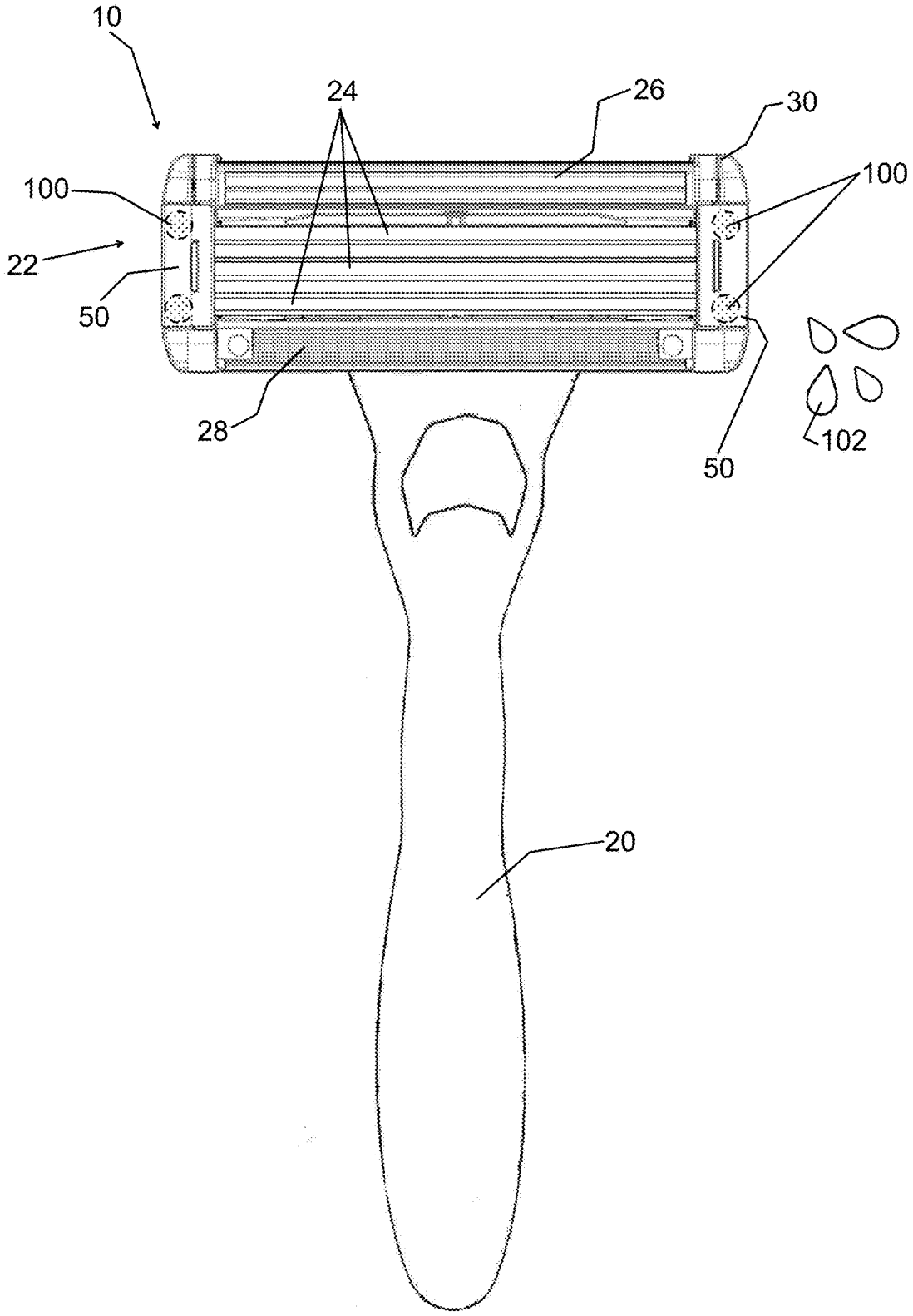
FIG. 1 is a front view of a razor having a cartridge with dispensers.

The accompanying drawings illustrate aspects of the present disclosure, and together with the general description given above and the detailed description given below, explain the principles of the present disclosure. As shown throughout the drawings, like reference numerals designate like or corresponding parts.

DETAILED DESCRIPTION

Referring to the drawings and, in particular, to FIG. 1, there is shown a razor assembly or razor for shaving according to the present disclosure and generally represented by reference numeral 10. Razor 10 has an elongate handle 20 for grasping with a hand. Handle 20 is directly or indirectly connected to a cartridge 22. Cartridge 22 has a housing 30, retaining element 50 for one or more razor blades 24 and a lubricating element dispenser 100 for dispensing a shaving aid, such as, a lubricating element or composition 102.

Shaving aids include, but are not limited to, a lubricant, a moisturizer, a conditioner, an emollient or any combinations thereof.

As noted above, the lubricating composition 102 is a skin lubricating composition 102 that enhances glideness and/or lubricity of razor 10 during use. The lubricating composition 102 can act as a hair or whiskers softener to facilitate cutting, depending on the formulation. The lubricating composition 102 optionally delivers a nutrient or cosmetic ingredient to the skin achieving skin benefits that include hydration, soothing, and the like.

The dispenser 100 provides a large lubricating surface area and/or multiple loci than conventional razors. This large lubricating surface area and/or multiple loci can provide lubrication on at least one area or in some aspects in multiple areas, without increasing or substantially increasing, the conventional dimension of the razor head.

Figure 2:
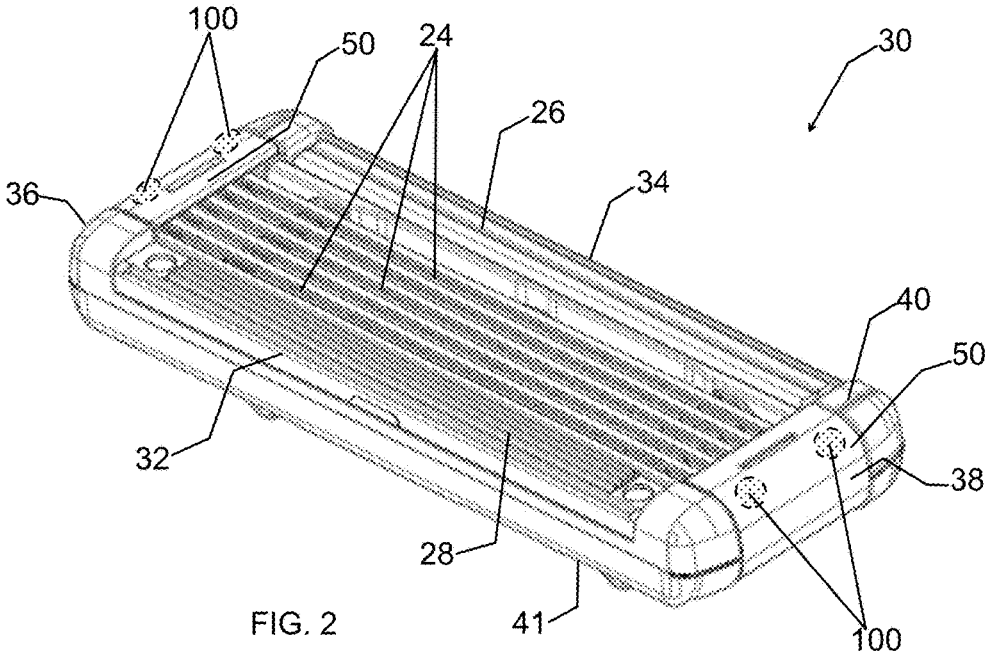
FIG. 2 is a perspective view of the cartridge with dispensers shown in FIG. 1.

Referring to FIG. 2, the housing 30 has a front edge 32, a rear edge 34, a pair of side edges 36, 38, a top surface 40, and a bottom surface 41. The pair of side edges 36, 38 extend between front edge 32 and rear edge 34. In some examples, the top surface 40 can be a skin engaging surface. The blades 24 can be secured in the housing 30 between the side edges 36 and 38 by one or more retaining elements 50.

According to some aspects, the retaining elements 50 is a retainer for the blades. The retaining elements 50 can be, for example, any suitably-configured component that can be attached on or cover the housing unitarily or partially. The retaining elements can also include, but are not limited to, skin adaptors, auxiliary devices that provide extended skin engaging surfaces and/or inner free volumes or compartments, lubricating frames, such as boxes with embedded cavities, such as containers or customizing tools having free spaces or volumes.

Figure 3:
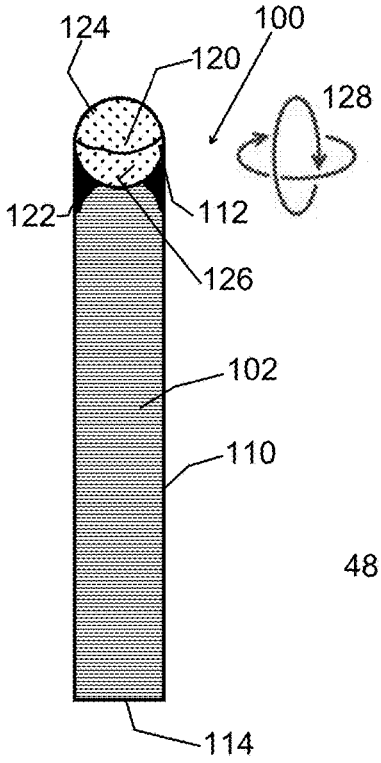
FIG. 3 is schematic side view of the lubricating element dispenser of the cartridge shown in FIG. 2.

Referring to FIG. 3, the dispenser 100 includes an elongate container 110 defined by a closed first end 114 and an opened second end 112 opposite the first end 114. The closed first end 114 is a bottom end of the container 110 and the opened second end 112 is a top end of the container 110. An inner supporting arrangement such as, for example, a socket 122, disposed near the second end 112, is configured to receive and hold a lid 120 near the second end 112. The container 110 is shown filled with the lubricating composition 102. The lid 120 is retained in the socket 122 and is configured to freely rotate 360 degrees on the socket 122. Rotation of the lid 120 is indicated by the arrows 128 in FIG. 3. Free rotation by 360 degrees may be considered as, free rotation in two planes at the same time while preventing translation in any direction.

Figure 4:
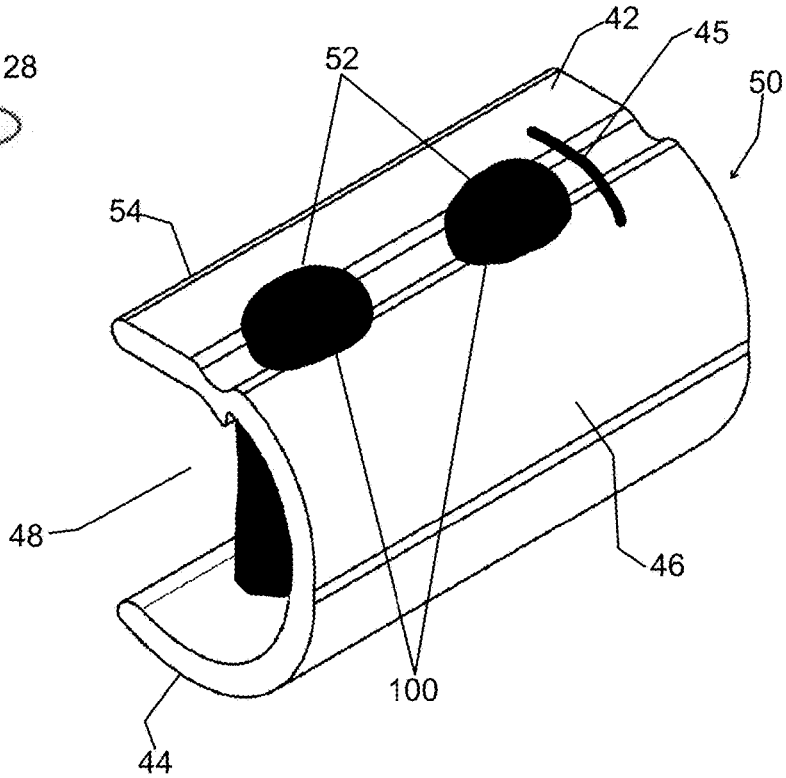
FIG. 4 is a side perspective view of a retaining element for the cartridge shown in FIG. 2.

As shown in FIG. 4, the retaining element 50 includes the dispenser 100. In one aspect, the retaining element 50 is configured to contact the skin of a user while shaving to dispense the lubricating composition 102 with each stroke.

The retaining element 50 includes a top surface 42 opposite a bottom surface 44. The top surface 42 and the bottom surface 44 are joined together by a side portion 46 to define an interior volume 48. The retaining element 50 has a width 54, for example, parallel to the side portion 46.

The top surface 42 includes an aperture 52 therethrough. However, according to other aspects, the aperture 52 can be disposed through the side portion 46, or between the top surface 42 and the side portion 46. The aperture 52 (and dispenser 100) can be disposed through an area of the retaining element 50 defined by the width 54 and line or arc 45 perpendicular thereto. This area may also be referred to as a skin contact area of the retaining element 50.

As shown in FIG. 4, the side portion 46 is detailed as having an arcuate shape. An arcuate shape can be used, for example, to maximize the interior volume 48. According to other aspects, the side portion 46 can have, for example, a parabolic shape, a hyperbolic shape, or a convex shape.

Figure 5:
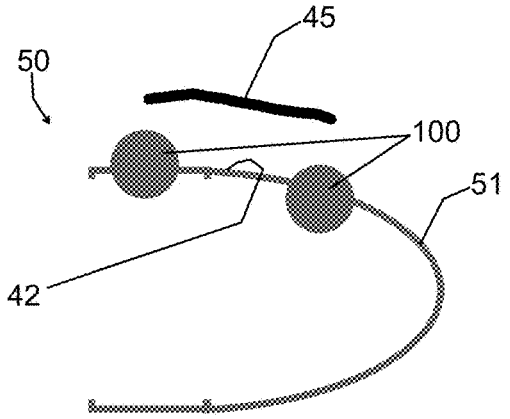
FIG. 5 is a schematic side view of another retaining element for the cartridge shown in FIG. 2.
Figure 6:
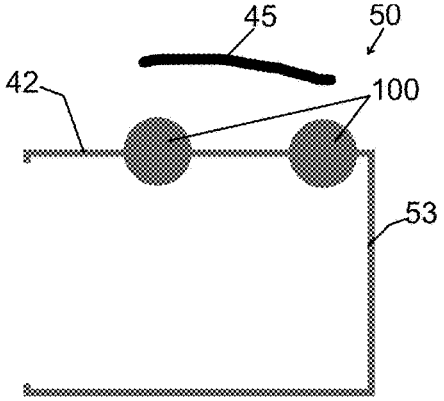
FIG. 6 is a schematic side view of yet another retaining element for the cartridge shown in FIG. 2.

Referring to FIGS. 5 and 6, the retaining element 50 is shown with side portions 51 and 53, respectively. The side portion 51 and the side portion 53 can be alternate configurations of the side portion 46 of FIG. 4. In general, the side portion 46 can be any shape suitable for creating an interior volume 48 for positioning container 110.

At least a portion of the top surface 42 is planar. However, according to other aspects, at least a portion of the top surface 42 can be arcuate.

The dispenser 100 is disposed through the aperture 52 so that the lid 120 protrudes at least partially from the top surface 42 and/or the side portion 46, and so that the dispenser 100 is substantially positioned in the interior volume 48. According to other aspects, the lid 120 of the dispenser 100 can be flush with the top surface 42, or the lid 120 can protrude at least about 0.07 mm and at most about 0.55 mm from the top surface 42.

Referring again to FIG. 3, the lid 120 is a spherical lid 120. However, according to other aspects, the lid 120 can be a sphere or spheroid that dispenses the lubricating composition 102 from the inside of the container 110 when rotated and rolled on the skin while shaving. The lid 120 includes an exterior portion 124 that is exposed to ambient atmosphere and an interior portion 126 that is inside container 110.

During use, when the lid 120 engages the skin of a user, friction between the skin and the lid 120 causes the lid 120 to roll and rotate thereby interchanging an interior portion 126 and an exterior portion 124. In other words, when the lid 120 rotates, the interior portion 126 also rotates and becomes the exterior portion 124 and vice versa. This allows an outer surface of the lid 120 to dive in the lubricating composition 102 with which the container 110 is filled so that as the lid 120 rotates, the lid 120 becomes coated with the lubricating composition 102.

The dispenser 100 allows for a progressive release of the lubricating composition 102, thereby preventing drying out of amounts of the unreleased lubricating composition 102 remaining in the container 110. Moreover, a rotatable spherical lid 120 allows for the lubricating composition 102 to be delivered directly to the skin and removes the requirement of water to activate the shaving aid or to act as a vehicle for delivery of the shaving aid to the skin.

The amount of lubricating composition 102 released per stroke is related to the geometrical characteristics of the container 110 and the lid 120, an applied force and speed per shaving stroke, environmental atmospheric conditions, and the rheological properties of the lubricating composition 102.

It has been found that the ease of rotation and release of lubricating composition 102 on the skin of a user by the dispenser 100 is predicated on the size of the lid 120. The selected size is affected by the force applied by the user while shaving. For example, smaller size lids 120 require greater forces rendering application of the lubricating composition 102 more suitable for male shaver products. Typical female users tend to avoid high pressure while shaving, and thus female shaver products tend to require, for example, a larger diameter lid 120 to assist with release of the lubricating composition 102.

In some embodiments, the lid 120 can be coated on an outer surface thereof with a low-friction film (e.g. carbonaceous) to reduce abrasion during use. The low-friction film can also help to extend the lifespan of the lid 120.

The container 110 is a cylindrical member or tube that has an inner diameter that is slightly greater than the diameter of the lid 120. Thus, the lid 120 fits tightly in the socket 122 but is free to rotate therein without falling out of the socket 122.

During assembly, the container 110 is fully filled with the lubricating composition 102, until the lubricating composition 102 is in contact with the interior portion 126 of the lid 120. When the lubricating composition 102 is in contact with the interior portion 126, the interior portion 126 soaks in the lubricating composition 102 so that at least some of the lubricating composition 102 is deposited on the outer surface of the lid 120. According to other aspects, the lubricating composition 102 can be added to the container 110 via an injection filling technique using, for example, a syringe.

Although the container 110 is shown in FIG. 3 as a tube or cylindrical member, other shapes, such as, for example, orthogonal, elliptical and spherical can be selected. Accordingly, an opening in the second end 112 and the socket 122 is geometrically shaped to correspond to the shape of the container 110 to receive the lid 120. According to further aspects, the container 110 can have two openings 252 formed in the second end 112 in which the two openings 252 are sized to hold respective lids 120 so that the lids 120 can freely rotate in the respective openings 252 without translation. See FIG. 7.

When the container 110 is a tube, the tube is disposed perpendicular or substantially perpendicular to the top surface 42.

The container 110 is made of a plastic, such as polyethylene or polypropylene. As such, a suitable manufacturing process for the production of the container 110 can include, but is not limited to, injection molding or extrusion. The container 110 can be co-molded with the retaining element 50. Assembly of the dispenser 100 includes using an injection flinging technique to fill the container 110 with the lubricating composition 102. The shape and size selection for the container 110 depends on the available space in the housing 30 such as the space available in the interior volume 48 and the size of the lid 120.

Conventional razor cartridges having an aluminum retainer serving as retaining element 50 for the blades can have, for example, approximately 2 $mm^3$ to 12.5 $mm^3$ of interior volume 48 that is available on each of the left and right sides where one or more containers 110 filled with the lubricating composition 102 may be positioned. According to aspects of the present disclosure, it is envisioned that up to 15 $mm^3$ of interior volume 48, for example, can be achieved when the shape of the side portion 46 includes a rectangular shape similar to the side portion 53, as shown in FIG. 6. Thus, the container 110 can have different shapes and sizes so as to adapt to the available free volume.

Figure 7:
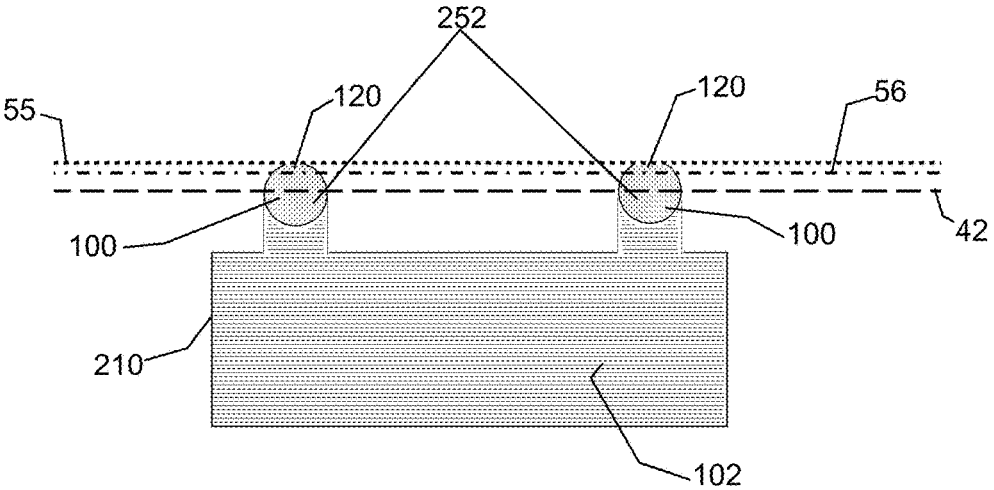
FIG. 7 is schematic side view of another lubricating element dispenser.

Referring to FIG. 7, an alternate container 210 for the lubricating composition 102, is shown as having two lids 120. The positions of the lid 120 when protruding with respect to the container 210 are similar to the position of the lid 120 as explained in connection with the container 110 of FIG. 4. The dashed line in FIG. 7 is representative of the top surface 42. The lid 120 is shown protruding in a first distance represented by dotted line 55. A second, shorter distance, is represented by dash dotted line 56.

In some embodiments, a single dispenser 100 can be disposed on each side of the housing 30. However, in other embodiments, a single dispenser 100 can be disposed on only one side of the housing 30.

According to other embodiments, a pair of dispensers 100 can be disposed on each side of the housing 30. According to other embodiments, a pair of dispensers 100 can be disposed on only one side of the housing 30. For example, there can be a pair of dispensers 100 each pair can be in parallel alignment with the side edges 36, 38. However, according to other aspects, the dispensers 100 can also be arranged in a grid.

Referring again to FIGS. 1 and 2, the housing 30 can include an optional lubricating strip 26 adjacent to the rear edge 34 for lubricating the skin, and a skin shield or guard bar 28 arranged proximate to the front edge 32 and between the pair of side edges 36, 38 to protect the user from injuries such as, for example, injuries that may be due to direct contact of the skin with the leading blade edge. Additionally, the guard bar 28 can stretch the skin for better shaving performance.

Although the housing 30 of FIGS. 1 and 2 is illustrated with five razor blades 24, any number of blades can be used, inclusive of the use of a single blade.

Although the dispenser 100 has been described as being positioned in the retaining element 50, other positions also possible. For example, the dispenser 100 can be integrated in the guard bar 28 and/or can be located at any place in the retaining element 50 attached on the housing 30, either unitarily or partially.

According to further aspects, the guard bar 28 can also include one or more cylindrical cavities, or other cavities having other shapes depending on the shape of the container 110. The dispenser 100 can be introduced in the cavities before final assembly of the housing 30 or after assembly of the housing 30 with the retaining element 50.

According to some aspects, the present disclosure also provides for the use of additional shaving aids, namely, the dispenser 100 can be in a razor housing to cooperate with other shaving aids such as, for example, lubricating strips and guard bars. The use of additional shaving aids can extend the lifetime of razor 10.

According to the present disclosure, various types of the lubricating composition 102 can be foreseen for use in the dispensers 100 as disclosed herein. The lubricating composition 102 can include liquid lubricating formulations such as for example, water-based lubricants, oil-based lubricants, silicone-based lubricants, solvent-based lubricants, and combinations thereof.

The lubricating composition 102 is a composition that includes at least a solvent and formulation additives. In some embodiments, the solvent can be a lubricant. In other embodiments, the formulation additives can include a lubricant. In yet other embodiments, the lubricating composition 102 can also include a cosmetic ingredient.

The solvent can be a water, oil, silicone or liquid-based compound acting as solvent, such as for example, Polyethylene Glycols (PEGs).

The formulation additives can include, but are not limited to, a humectant, a thickener, a surfactant, a solubilizer, a stabilizer, a ph adjuster, a chelating agent, a preservative, an emulsion stabilizing agent, an emulsifier (non-ionic and/or oil-in-water), a viscosity controlling agent and/or viscosifier, an agent with suspending properties, an antioxidant, an antifoaming agent, a buffering compound, a film forming compound, a gel forming compound, or any combinations thereof.

Suitable solvent-based lubricants can include, but are not limited to, liquid-based Polyethylene Glycols (PEGs) with polyvinyl pyrrolidone (PVP); additives; solvent and cosmetic ingredients such as aloe vera and Vitamin E and A; oil extracts such as tea tree, lavender and peppermint; hair softeners and conditioning agents; and perfumes.

Suitable solvents for the water-based, oil-based, silicone-based lubricants can be, for example, water/aqua, hexylene glycol, phenyl propanol, propylene glycol and similar. Additionally, alcohols can be used acting as solvents that achieve drying of the lubricating composition 102 on the outer surface of the lid 120, and avoid leakage when razor is not used.

Regarding the formulation additives, one or more compounds selected from these categories may have multiple functions. For example, a suitable formulation additive, such as a humectant, can include but is not limited to glycerin, propylene glycol, capryl glycol, aloe vera and similar components.

The surfactant can include, but is not limited to, trideceth-11 and a non-ionic surfactant such as PEG-7 glyceryl cocoate.

The solubilizer can include, but is not limited to, PEG-40 hydrogenated castor oil, laureth-9 and similar components.

The stabilizer can include, but is not limited to, an acrylate/C10-30 alkyl acrylate cross polymer and similar components.

The pH adjuster can include, but is not limited to, sodium hydroxide, citric acid, aminomethyl propanol and similar components.

The chelating agent can include, but is not limited to, calcium disodium EDTA.

The preservative can include, but is not limited to, chlorhexidine glyconate, methylparaben, potassium sorbate, sodium benzoate, phenoxyethanol, DMDH hydration, methylisothiazolinone, hexylene glycol, and/or preservative with boosting capacities especially against fungi such as phenylpropanol and similar components.

The emulsion stabilizing agent can include, but is not limited to, carbomer, hydroxyethylcellulose, guar gum, locust bean gum, xantham gum, sodium carboxymethyl cellulose, beeswax and similar components.

The emulsifier can include, but is not limited to, laureth-9 as non-ionic emulsifier and/or PEG-40 hydrogenated castor oil and similar as oil-in water emulsifier.

The viscosity controlling agent or viscosifer can include, but is not limited to, glycerin, sodium chloride, propylene glycol, shea butter and/or beeswax.

The agent with suspending properties can include, but is not limited to, acrylate/C10-30 alkyl acrylate cross-polymer.

The antioxidant can include, but is not limited to, Vitamin E.

The antifoaming agent can include, but is not limited to, dimethiconol.

The buffering compound can include. but is not limited to, aminomethyl propanol.

The film forming compound can include, but is not limited to, hydroxyethyl cellulose, sodium carboxymethyl cellulose and similar components.

The gel forming compound can include, but is not limited to, xantham gum, carbomer and similar components.

Regarding the cosmetic ingredients, one or more compounds selected from these categories may have multiple functions. For example, a suitable cosmetic ingredient can be an allergen or a thickener. The allergen can include, but is not limited to, limonene. The suitable thickener can include, but is not limited to, hydroxyethyl cellulose, guar gum, locust bean gum, xantham gum, acrylates/C10-30 alkyl acrylate cross polymer, sodium carboxymethyl cellulose, and carbomer.

According to further embodiments, the lubricating composition 102 can also include a cosmetic ingredient. The cosmetic ingredient can include, but are not limited to, an allergen, an emollient, a skin conditioning agent, a skin soothing agent and a skin protectant, hair conditioning and beard softeners, moisturizing and hydrating agents, an antimicrobial agent, a masking agent, perfume or fragrance, colorants, cooling agents and/or essential oils.

The emollient can include, but is not limited to, avena sativa extract, sunflower seed oil, beeswax, cocoa seed butter, cyclopentasiloxane, dimethicone, dimethiconol, PEG-7 glycerol cocoate, capryl glycol, oils, lipids, waxes, fats and similar components.

The skin conditioning agent, skin soothing agent and/or skin protectant can include, but is not limited to, propylene glycol, glycerin, shea butter, cocoa seed butter, sweet almond oil, glyconolactone, hexylene glycol, mentha piperita, avena sativa extract, sunflower seed oil, vitamin E, cyclopentasiloxane, dimethicone, aloe vera, flax extract, xantham gum, dexpanthenol, humulus lupulus extract, capryl glycol and similar components.

The hair conditioning and beard softener can include, but is not limited to, glycerin, aloe vera, dexpanthenol, humulus lupulus extract and similar components.

The moisturizing and hydrating agent can include, but is not limited to, dimethiconol.

The antimicrobial agent can include, but is not limited to, phenethyl alcohol, humulus lupulus extract and similar components.

The masking agent can include, but is not limited to, phenethyl alcohol.

The perfume or fragrance can include, but is not limited to, mentha piperita, phenylopropanol and similar perfumes/fragrances.

The lubricating composition 102 has a low viscosity, for example, of about 300 to about 3000 cps. According to other aspects, the lubricating element can have a low viscosity of about 500 to about 2000 cps, and more specifically, of about 500 to about 1000 cps, for example. The viscosity ranges noted have been found, in many instances, to facilitate an enhanced rotation of the lid 120.

When a certain structural element is described as "is connected to", "is coupled to", or "is in contact with" a second structural element, it should be interpreted that the second structural element can "be connected to", "be coupled to", or "be in contact with" another structural element, as well as that the certain structural element is directly connected to or is in direct contact with yet another structural element.

It should be noted that the terms "first", "second", and the like can be used herein to modify various elements. These modifiers do not imply a spatial, sequential or hierarchical order to the modified elements unless specifically stated.

As used herein, the terms "a" and "an" mean "one or more" unless specifically indicated otherwise.

As used herein, the term "substantially" means the complete or nearly complete extent or degree of an action, characteristic, property, state, structure, item, or result. For example, an object that is "substantially" enclosed means that the object is either completely enclosed or nearly completely enclosed. The exact allowable degree of deviation from absolute completeness can in some cases depend on the specific context. However, generally, the nearness of completion will be to have the same overall result as if absolute and total completion were obtained.

As used herein, the term "about" is used to provide flexibility to a numerical range endpoint by providing that a given value can be "a little above" or "a little below" the endpoint. Further, where a numerical range is provided, the range is intended to include any and all numbers within the numerical range, including the end points of the range.

While the present disclosure has been described with reference to one or more exemplary aspects, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular aspects disclosed herein, but that the disclosure will include all aspects falling within the scope of a fair reading of appended claims.

What is claimed is:

1. A retaining element for a razor cartridge, the retaining element comprising:

a top portion that includes an aperture therethrough, a bottom portion, and a side portion connecting the top portion to the bottom portion to define a volume between the top portion and the bottom portion;

a container having a top opening; a lubricating composition in the container; and a first spherical lid to cap the container, wherein the top opening is sized to hold the first spherical lid so that the first spherical lid freely rotates without translation, wherein the container is positioned in the volume so that the first spherical lid at least partially protrudes from the aperture, and wherein at least some of the lubricating element emits onto an outer surface of the first spherical lid when the first spherical lid rotates.

2. The retaining element of claim 1, wherein the container has a second top opening that is sized to hold a second spherical lid so that both the first and the second spherical lids freely rotates in the respective top openings without translation.

3. The retaining element of claim 1, wherein the lubricating composition has a viscosity in the range from about 300 to about 3000 cps.

4. The retaining element of claim 1, wherein the lubricating composition is a shaving aid that is selected from the group consisting of: a lubricant, a moisturizer, a conditioner, an emollient, and any combinations thereof.

5. The retaining element of claim 4, wherein the lubricating composition is a lubricant that is selected from the group consisting of: water-based lubricants, oil-based lubricants, silicone-based lubricants, and solvent-based lubricants.

6. The retaining element of claim 1, wherein the container is a tube.

7. The retaining element of claim 1, wherein the first spherical lid has a surface that is coated with a low-friction film.

8. The retaining element of claim 1, further comprising a supporting arrangement in the container that is configured to hold the first spherical lid at the top end of the container.

9. The retaining element of claim 8, wherein the supporting arrangement is a socket.

10. The retaining element of claim 1, wherein the container is integrally formed with the retaining element.

11. A razor cartridge, the cartridge comprising:

a blade disposed in a housing;

a retaining element configured to maintain the blade in the housing, wherein the retaining element has a top portion that includes an aperture therethrough, a bottom portion, and a side portion connecting the top portion to the bottom portion to define a volume between the top portion and the bottom portion; and a container for containing a lubricating composition and capped with a spherical lid, wherein the container includes a top opening sized to hold the spherical lid so that the spherical lid freely rotates without translation, wherein the container is positioned in the volume so that the spherical lid at least partially protrudes from the aperture, and wherein at least some of the lubricating element is transferred from the container to an outer surface of the spherical lid when the spherical lid rotates.

12. The razor cartridge of claim 11, wherein the top portion has a top surface and the spherical lid protrudes from the top surface.

13. The razor cartridge of claim 12, wherein the top surface is planar.

14. The razor cartridge of claim 12, wherein the container is a tube disposed substantially perpendicular to the top surface.

15. The razor cartridge of claim 11, wherein the cartridge has a top surface, a front edge, a rear edge and a pair of side edges that extend between the front and the rear edges, and wherein the cartridge further comprises a guard bar arranged proximate to the front edge between the pair of side edges.

16. The razor cartridge of claim 11, wherein the container further comprises a supporting arrangement that is configured to hold the spherical lid at the top end of the container.

17. The razor cartridge of claim 16, wherein the supporting arrangement is a socket.

18. The razor cartridge of claim 11, wherein the lubricating composition is a shaving aid that is selected from the group consisting of: a lubricant, a moisturizer, a conditioner, an emollient, and any combinations thereof.

19. The razor cartridge of claim 18, wherein the lubricating composition is selected from the group consisting of: water-based lubricants, oil-based lubricants, silicone-based lubricants, and solvent-based lubricants.

20. A razor assembly with a razor cartridge, the razor assembly comprising:

a housing for the razor cartridge;

a handle connected to the housing;

a blade disposed in the housing;

a retaining element configured to maintain the blade in the housing, wherein the retaining element has a top portion that includes an aperture therethrough, a bottom portion, and a side portion connecting the top portion to the bottom portion to define a volume between the top portion and the bottom portion; and a container for holding a lubricating element and capped with a spherical lid, wherein the container has a top opening sized to hold the spherical lid so that the spherical lid freely rotates without translation, wherein the container is positioned in the volume so that the spherical lid at least partially protrudes from the, and wherein at least some of the lubricating element is transferred from the container to an outer surface of the spherical lid when the spherical lid rotates.

* * * * *